US008107868B2

(12) United States Patent
Kimura

(10) Patent No.: US 8,107,868 B2
(45) Date of Patent: Jan. 31, 2012

(54) IMAGE FIXING DEVICE CONTAINING A HEAT GENERATING UNIT ARRANGED AT AN END PORTION OF A HEATER AND AN APPARATUS HAVING THE SAME

(75) Inventor: Taku Kimura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 120 days.

(21) Appl. No.: 12/421,029

(22) Filed: Apr. 9, 2009

(65) Prior Publication Data

US 2009/0263169 A1 Oct. 22, 2009

(30) Foreign Application Priority Data

Apr. 16, 2008 (JP) ..... 2008-106475

(51) Int. Cl.
*G03G 15/20* (2006.01)

(52) U.S. Cl. ..... 399/329

(58) Field of Classification Search ..... 399/328, 399/329, 335; 219/216
See application file for complete search history.

(56) References Cited

U.S. PATENT DOCUMENTS 5,832,353 A * 11/1998 Sano ..... 399/329
6,631,253 B2 * 10/2003 Nakafuji et al. ..... 399/329
6,826,382 B2 * 11/2004 Sanpei et al. ..... 399/328
6,864,461 B2 * 3/2005 Okabayashi et al. ..... 219/216
6,958,645 B2 * 10/2005 Okabayashi ..... 329/329
7,570,911 B2 * 8/2009 Nakafuji et al. ..... 399/329
7,769,333 B2 * 8/2010 Shin et al. ..... 399/329
7,773,930 B2 * 8/2010 Shin et al. ..... 399/329
2009/0136274 A1 * 5/2009 Kobayashi ..... 399/329

FOREIGN PATENT DOCUMENTS

JP 2002-333788 A 11/2002
JP 2002333788 A * 11/2002
JP 2003243130 A * 8/2003
JP 2004184607 A * 7/2004
JP 2005-181838 A 7/2005
JP 2006/072182 A 3/2006
JP 2006058418 A * 3/2006
JP 2007-322888 A 12/2007

* cited by examiner

*Primary Examiner* — Robert Beatty
(74) *Attorney, Agent, or Firm* — Marvin A. Motsenbocker; Mots Law, PLLC

(57) ABSTRACT

An aspect of the invention provides a fixing device that comprises: an endless fixing belt; a first rotating body arranged at an inner side of the fixing belt; and a heater arranged to face an inner surface of the fixing belt and configured to heat the fixing belt and to suspend the fixing belt in a tensioned state together with the first rotating body, the heater comprising: a heat generating unit arranged at an end portion of the heater on a downstream side in a direction of travel of the fixing belt and configured to heat the fixing belt; and a support including metal and configured to support the heat generating unit.

15 Claims, 12 Drawing Sheets

IMAGE FIXING DEVICE CONTAINING A HEAT GENERATING UNIT ARRANGED AT AN END PORTION OF A HEATER AND AN APPARATUS HAVING THE SAME

CROSS REFERENCE TO RELATED APPLICATIONS

This application claims priority based on 35 USC 119 from prior Japanese Patent Application No. P2008-106475 filed on Apr. 16, 2008, entitled "Fixing Device and Image Forming Apparatus", the entire contents of which are incorporated herein by reference.

BACKGROUND OF THE INVENTION

1. Field of the Invention

This invention relates to a fixing device and an image forming apparatus.

2. Description of Related Art

A conventional fixing device used in an image forming apparatus such as a printer, a copier, a facsimile machine or a multi-function machine for forming black-and-white or color images includes a sheet heating element, which is placed in contact with an inner surface of a fixing belt, is suspended in a tensioned state around a fixing roller. A print medium having a developed image transferred to a surface thereof is conveyed while subjected to heat and pressure by the fixing roller and a pressure roller. The pressure roller is configured to apply pressure to the print medium while rotating in pressure contact with the fixing roller. In this way, the developer image is fixed onto the print medium.

However, this conventional fixing device has low efficiency of heat transfer to the fixing belt.

SUMMARY OF THE INVENTION

An aspect of the invention provides a fixing device that comprises: an endless fixing belt; a first rotating body arranged at an inner side of the fixing belt; and a heater arranged to face an inner surface of the fixing belt and configured to heat the fixing belt and to suspend the fixing belt in a tensioned state together with the first rotating body, the heater comprising: a heat generating unit arranged at an end portion of the heater on a downstream side in a direction of travel of the fixing belt and configured to heat the fixing belt; and a support including metal and configured to support the heat generating unit.

Another aspect of the invention provides an image forming apparatus that comprises the fixing device above.

According to the fixing device above, the sheet heating element is arranged at the end portion of the heater on the downstream side in the direction of travel of the fixing belt, the heater configured to heat the fixing belt. In this way, it is possible to improve the efficiency of heat transfer to the fixing belt, to heat the fixing belt to a predetermined temperature in a short time period, and to reduce setup time required to begin fixing.

DETAILED DESCRIPTION OF EMBODIMENTS

Figure 1:
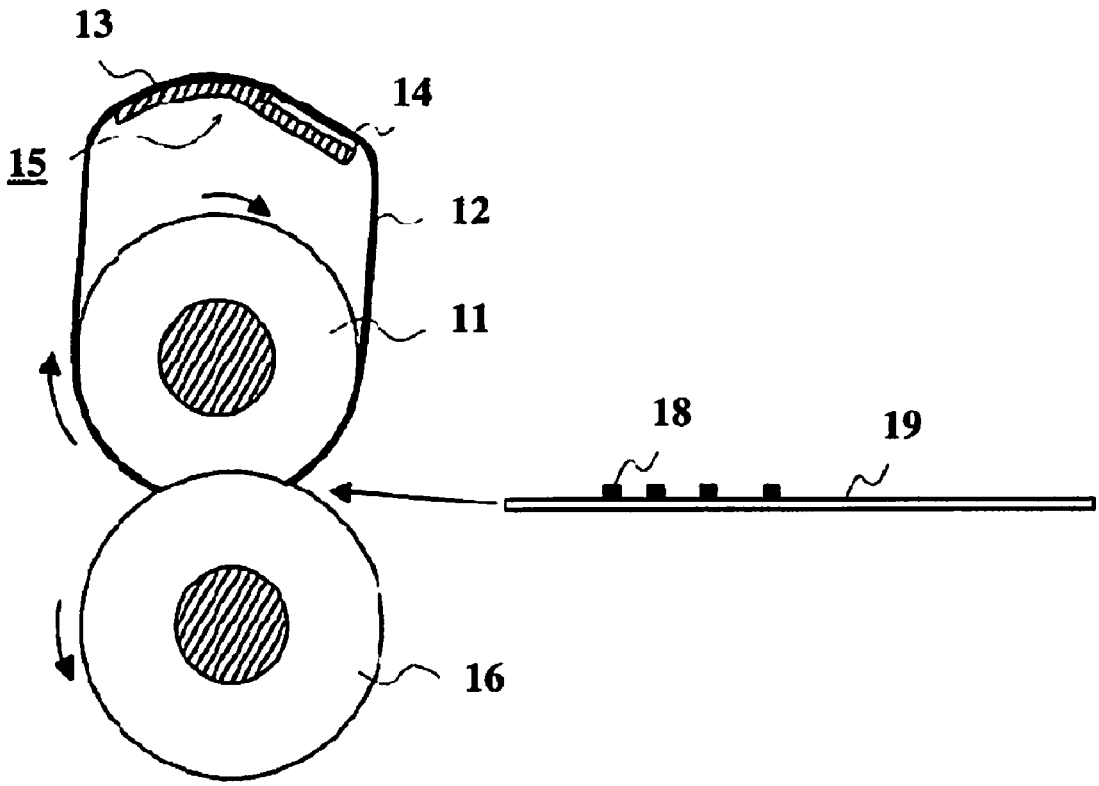
FIG. 1 is a cross-sectional view of a fixing device in a first embodiment.

Descriptions are provided herein-below for embodiments based on the drawings. In the respective drawings referenced herein, the same constituents are designated by the same reference numerals and duplicate explanation concerning the same constituents is basically omitted. All of the drawings are provided to illustrate the respective examples only. No dimensional proportions in the drawings shall impose a restriction on the embodiments. For this reason, specific dimensions and the like should be interpreted with the following descriptions taken into consideration. In addition, the drawings include parts whose dimensional relationship and ratios are different from one drawing to another.

Figure 2A:
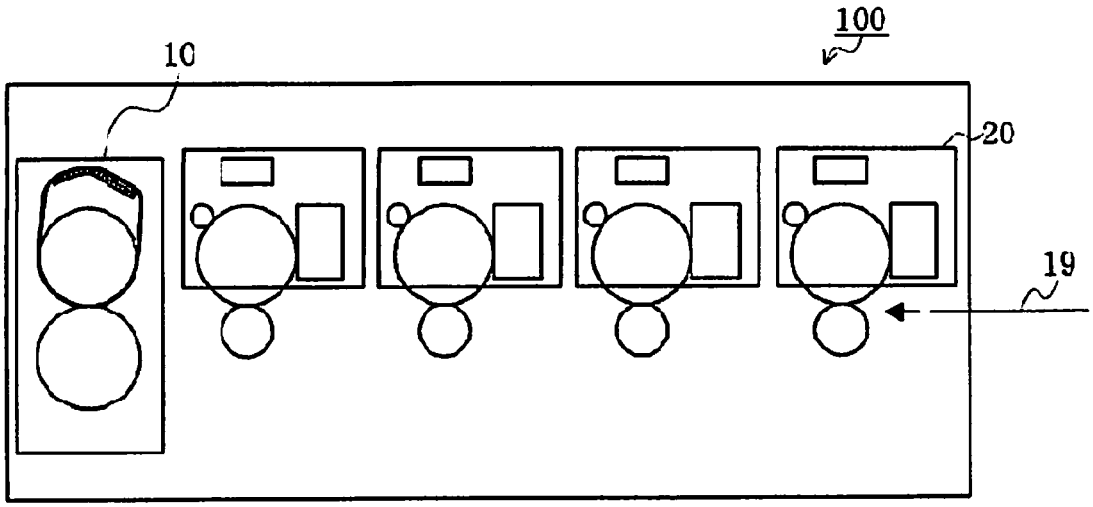
FIG. 2A and FIG. 2B are schematic side views showing an image forming apparatus including the fixing device in the first embodiment.
Figure 2B:
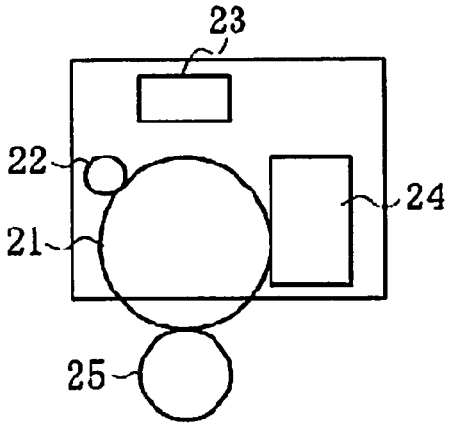

FIG. 2A and FIG. 2B are schematic side views showing an image forming apparatus 100 including a fixing device 10 according to a first embodiment. Here, FIG. 2A is the side view showing the entire image forming apparatus 100 while FIG. 2B is the side view showing a developing device 20.

Image forming apparatus 100 is, for example, a printer, a facsimile machine or a copier, which is configured to form black-and-while (monochrome) or color images on recording medium 19 such as a print sheet, an envelope or an overhead projector (OHP) sheet by use of an electrographic method. Here, image forming apparatus 100 may be configured to form either monochrome images or color images. In this embodiment, image forming apparatus 100 is described as an apparatus configured to form color images, such as a color printer, a color facsimile machine or a color copier.

Image forming apparatus 100 includes developing devices 20 which are arranged in the direction of travel of recording medium 19 and configured to respectively form toner images on recording medium 19 using two or more colors, namely, toner images in four colors of black, yellow, magenta, and cyan. Here, each developing device 20 includes: image carrying member 21 such as a photosensitive drum or a photosensitive belt configured to carry a toner image of corresponding color; charging member 22 configured to charge the surface of image carrying member 21 by supplying electric charges thereto; latent image forming unit 23 configured to subject the surface of image carrying member 21 to light exposure to form an electrostatic latent image; and developing unit 24 configured to attract toner to the electrostatic latent image formed on image carrying member 21 thereby forming a visible toner image. Additionally, image forming apparatus 100 includes transferring member 25 configured to transfer the toner image formed by developing unit 24 onto recording medium 19.

Charging member 22 inside image forming apparatus 100 charges the surface of image carrying member 21. The latent image is formed by latent image forming unit 23. Developing unit 24 forms the toner image on image carrying member 21 by developing this electrostatic latent image. Transferring member 25 transfers this toner image from the surface of image carrying member 21 onto recording medium 19.

Fixing device 10 is arranged on the downstream side of developing devices 20 in the direction of travel of recording medium 19. Fixing device 10 fixes the toner image which is transferred onto recording medium 19.

Next, a configuration of fixing device 10 is described in detail. FIG. 1 is a cross-sectional view of fixing device 10 in the first embodiment. As shown in FIG. 1, fixing device 10 includes fixing roller 11 as a fixing member that is a first rotating body, pressing roller 16 as a pressing member that is a second rotating body, fixing belt 12 as an endless belt, and heater 15. Fixing device 10 applies heat and pressure to toner 18 of the toner image transferred onto recording medium 19 thereby fixing toner 18 to recording medium 19. Heater 15 includes sheet heating element 14 as a heat generating unit and a support 13 which is integrated with sheet heating element 14 so as to support sheet heating element 14. Moreover, fixing belt 12 is suspended in a tensioned state between fixing roller 11 and support 13.

Here, sheet heating element 14 is arranged to be pressed, together with support 13, against an inner surface of fixing belt 12. In this case, the pressure load of support 13 against fixing belt 12 is preferably set approximately equal to 2 [kg·f] at the maximum so as not to minimize sliding friction between support 13 and fixing belt 12.

Pressing roller 16 is pressed against fixing roller 11 with fixing belt 12 interposed there-between. Further, an unillustrated temperature sensor is arranged either on an outer surface or on an inner surface of fixing belt 12. The temperature sensor may be in contact with fixing belt 12 or may be formed as a non-contact component having a small gap between the temperature sensor and fixing belt 12.

Figure 3A:
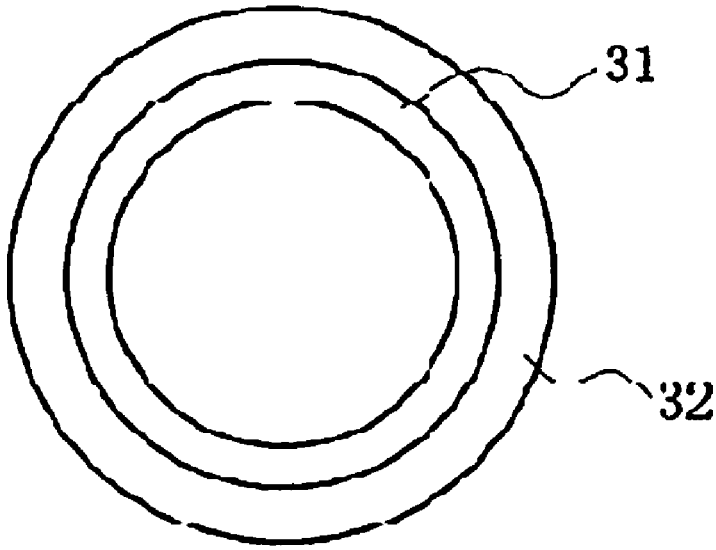
FIG. 3A and FIG. 3B are cross-sectional views of a fixing roller and a pressure roller in the first embodiment.
Figure 3B:
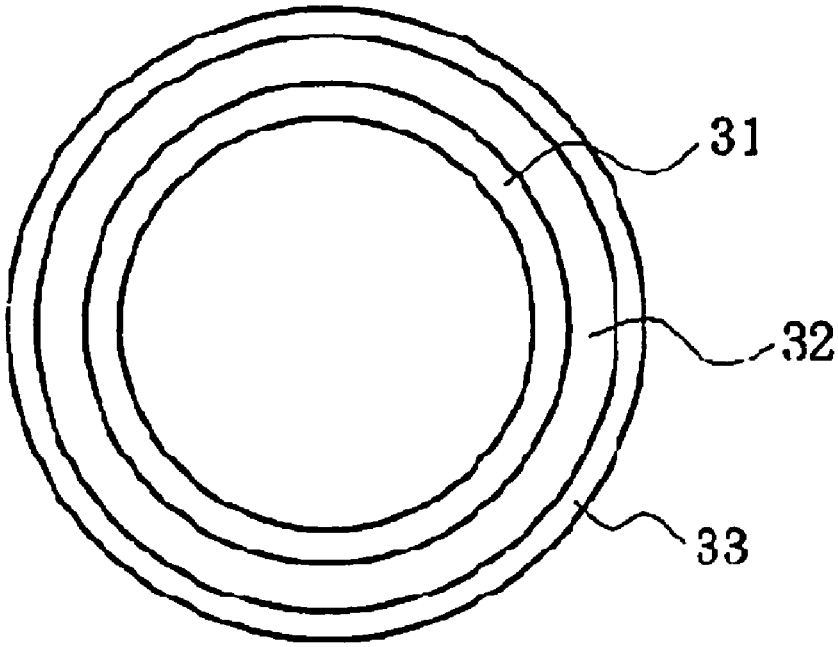

Next, configurations of fixing roller 11 and pressing roller 16 are described in detail. FIG. 3A and FIG. 3B are cross-sectional views of the fixing roller and the pressure roller in the first embodiment. Here, FIG. 3A is the view showing a layer structure of both the fixing roller and the pressure roller and FIG. 3B is the view showing a modified example of a layer structure of the pressure roller.

As shown in FIG. 3A, fixing roller 11 and pressure roller 16 each include cored bar 31 having either a cylindrical or a columnar shape, and elastic layer 32 formed around cored bar 31. Here, as shown in FIG. 3B, pressing roller 16 may further include releasing layer 33 which is formed around elastic layer 32.

Cored bar 31 is preferably a solid or hollow shaft made of a metal such as aluminum, iron, or stainless steel in order to maintain a specified rigidity. It is usually preferable that elastic layer 32 include a highly heat-resistant rubber material such as silicone rubber, sponge silicone rubber or fluorine-containing rubber.

Referring to FIG. 1, pressure roller 16 is driven from an unillustrated motor or the like in a direction indicated with an arrow in FIG. 1. Fixing belt 12 is driven by friction with pressing roller 16 and is thereby rotated in a direction indicated with another arrow in FIG. 1. Further, fixing roller 11 is driven by friction with fixing belt 12 and is thereby rotated in a direction indicated with yet another arrow in FIG. 1.

Figure 4A:
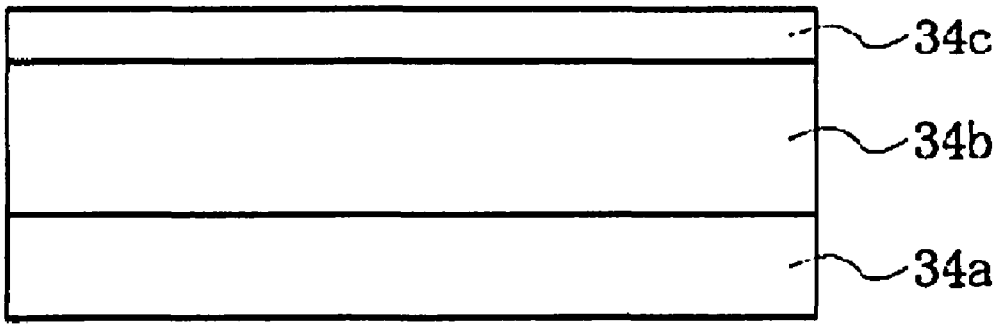
FIG. 4A and FIG. 4B are cross-sectional views of fixing belts in the first embodiment.
Figure 4B:
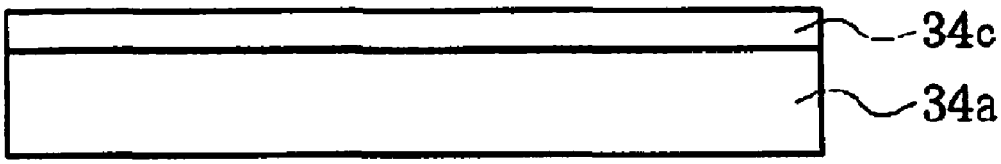

Next, the configuration of fixing belt 12 is described in detail. FIG. 4A and FIG. 4B are cross-sectional views of the fixing belt 12 in the first embodiment. Here, FIG. 4A is the view showing a layer structure of the fixing belt and FIG. 4B is the view showing a modified example of the layer structure of the fixing belt.

As shown in FIG. 4A, fixing belt 12 is a laminated body which includes thin base body 34*a*, elastic layer 34*b* formed on base body 34*a*, and releasing layer 34*c* formed on elastic layer 34*b*. Alternatively, as shown in FIG. 4B, fixing belt 12 may be a laminated body which includes thin base body 34*a* and releasing layer 34*c* formed directly on base body 34*a*. As shown in FIG. 1, fixing belt 12 is suspended in a tensioned state between fixing roller 11 and support 13 with releasing layer 34*c* located on its outer side.

Here, base body 34*a* is preferably made of nickel, polyimide, stainless steel or the like as a main component and is preferably formed in a thickness range from about 30 to 150 [μm] to simultaneously achieve strength and flexibility.

Elastic layer 34*b* is preferably made of either a silicone rubber or a fluorine-containing resin as a main component. In the case of silicone rubber, it is preferable to set the thickness in a range from about 50 to 300 [μm] in order to simultaneously achieve low hardness and high heat conductivity. Alternatively, in the case of a fluorine-containing resin, it is preferable to set the thickness in a range from about 10 to 50 [μm] in order to simultaneously achieve low friction and high heat conductivity.

Further, similar to releasing layer 33 of pressing roller 16, releasing layer 34*c* is preferably made of a resin having high heat resistance and low surface free energy after shaping, for example, a typical fluorine-based resin such as polytetrafluoroethylene (PTFE), perfluoroalcoxyalkane (PFA) or perfluoroethylene-propene copolymer (FEP) as a main component. Here, it is preferable to set the thickness in a range from about 10 to 50 [μm].

Figure 5A:
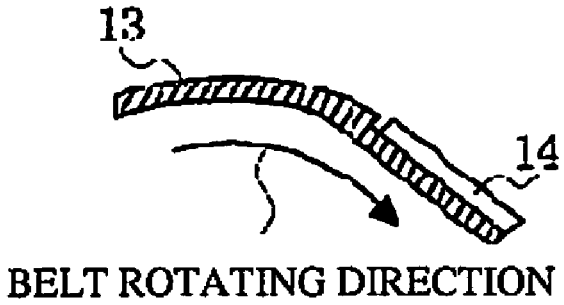
FIG. 5A, FIG. 5B, and FIG. 5C are cross-sectional views of heaters in the first embodiment.
Figure 5B:
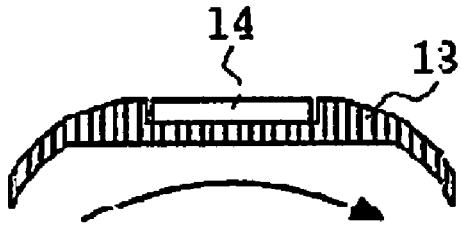
Figure 5C:
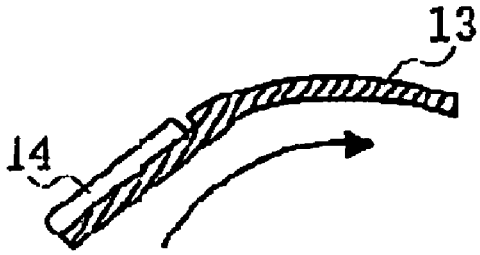
Figure 6A:
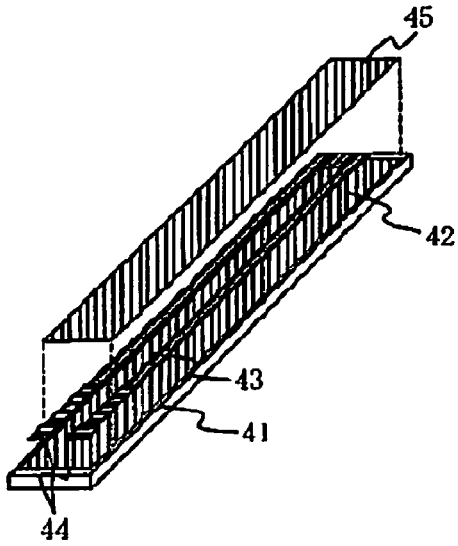
FIG. 6A, FIG. 6B, and FIG. 6C are exploded perspective views of sheet heating elements in the first embodiment.
Figure 6B:
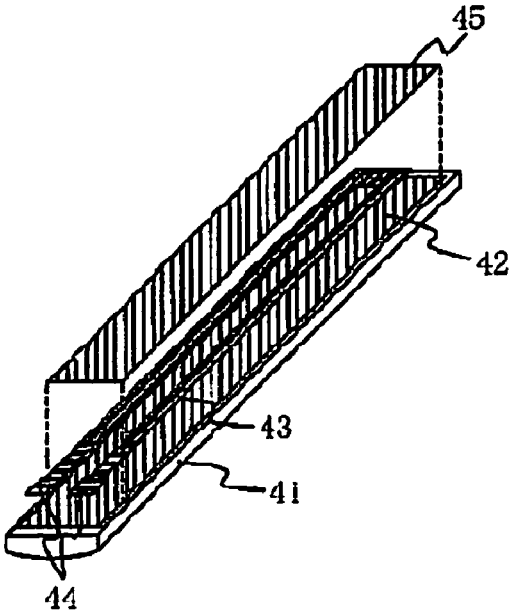
Figure 6C:
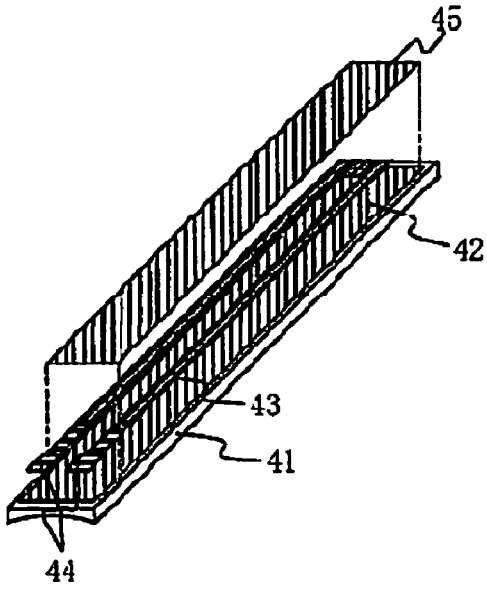
Figure 7A:
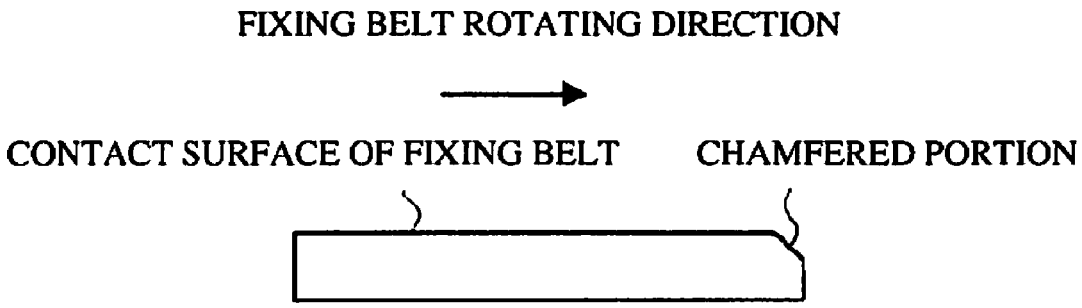
FIG. 7A and FIG. 7B are side views of the sheet heating element in the first embodiment.
Figure 7B:
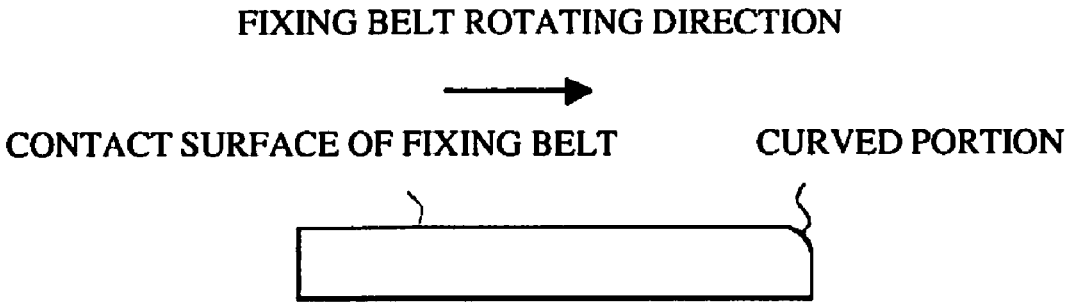
Figure 8:
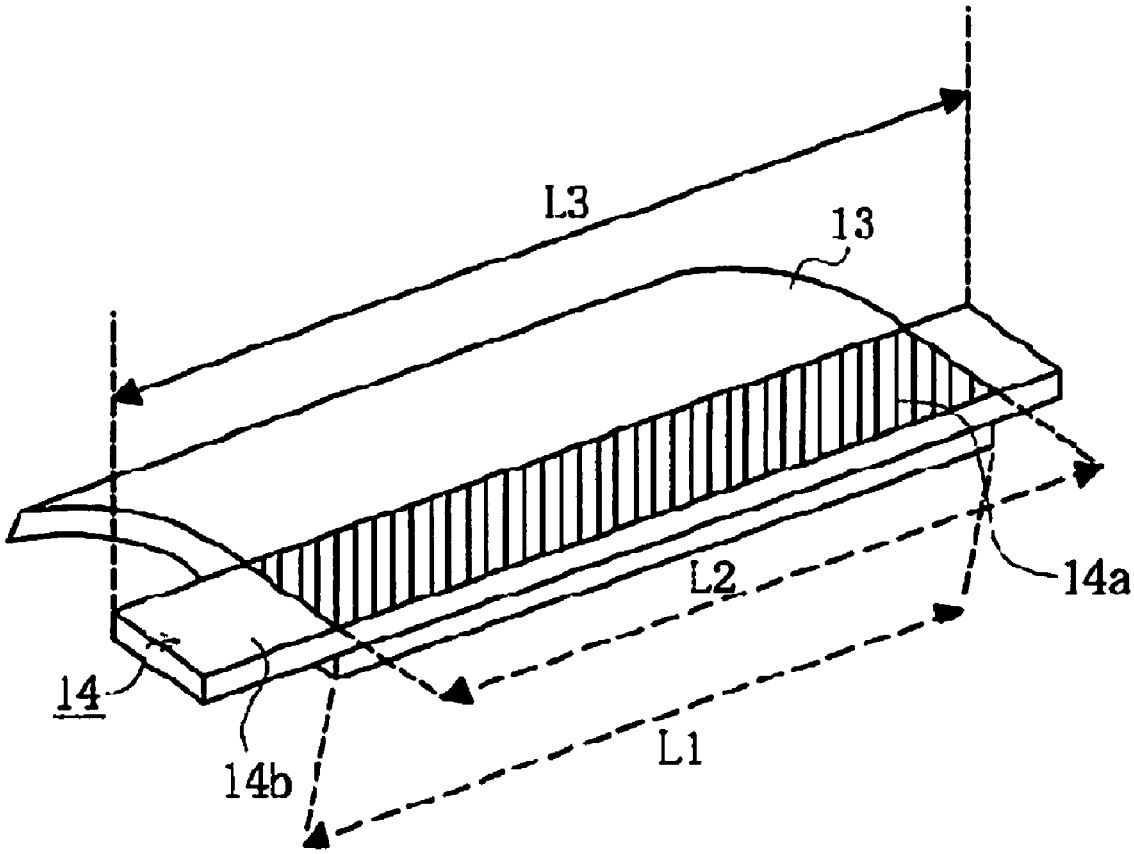
FIG. 8 is a perspective view of the heater in the first embodiment.
Figure 9:
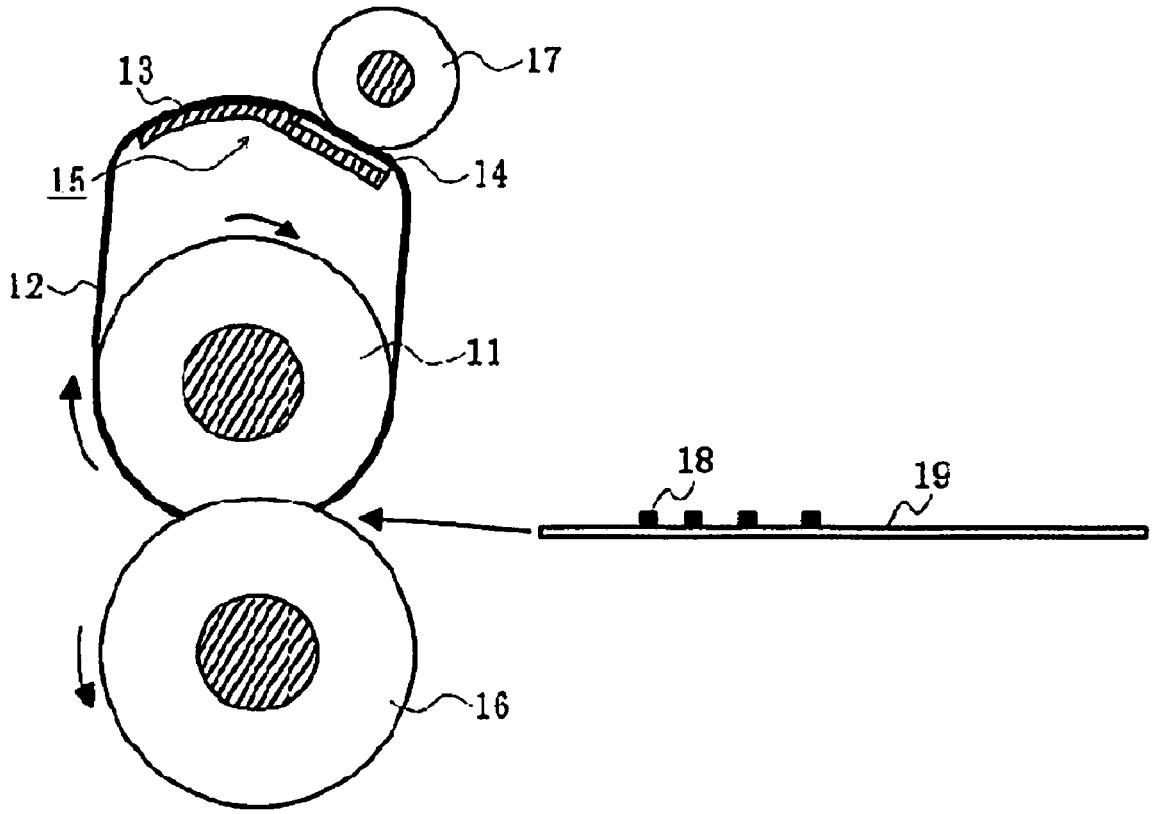
FIG. 9 is a cross-sectional view showing a modified example of the fixing device in the first embodiment.

Next, a configuration of heater 15 is described in detail. FIG. 5A, FIG. 5B, and FIG. 5C are cross-sectional views of alternate configurations of the sheet heating element in the first embodiment. FIG. 6A, FIG. 6B, and FIG. 6C are exploded perspective views of the alternate sheet heating element configurations in FIG. 5A, FIG. 5B, and FIG. 5C respectively. FIG. 7A and FIG. 7B are side views of the sheet heating element in the first embodiment. FIG. 8 is a perspective view of the sheet heating element in the first embodiment. FIG. 9 is a cross-sectional view showing a modified example of the fixing device in the first embodiment. Here, FIG. 5A is the view showing a position of the sheet heating element, FIG. 5B is the view showing a position of the sheet heating element in a first alternate example, and FIG. 5C is the view showing a position of the sheet heating element in a second alternate example. FIG. 6A is the view showing a layer structure of the sheet heating element, FIG. 6B is the view showing a layer structure of the sheet heating element of the first alternate example, and FIG. 6C is the view showing a layer structure of the sheet heating element of the second alternate example. FIG. 7A is the view showing a shape of a corner portion of the sheet heating element and FIG. 7B is the view showing a shape of the corner portion of the sheet heating element of an alternate example.

Support 13 is preferably made of any one of: a metal having high heat conductivity and high workability such as aluminum or copper; an alloy that contains any of such metals as a main component; and any of iron, an iron alloy, stainless steel and the like having high heat resistance and high rigidity. Note that support 13 is integrated with sheet heating element 14 by pressing against pressure roller 16 with fixing belt 12 interposed there-between. Accordingly, it is not necessary to bond support 13 to sheet heating element 14. As shown in FIG. 5A, sheet heating element 14 is preferably arranged at an end portion of support 13 on a downstream side in a rotating direction of fixing belt 12, that is, in the direction of travel thereof.

Here, sheet heating element 14 may be arranged at an end portion of support 13. Specifically, as shown in the examples shown in FIG. 5A and in FIG. 5C, no more than two side surfaces of sheet heating element 14 are surrounded by support 13 so that one side surface of sheet heating element 14 constitutes an end surface of heater 15. Incidentally, in the example shown in FIG. 5B, sheet heating element 14 is not arranged at the end portion of support 13 so that three side surfaces of sheet heating element 14 are surrounded by support 13.

In addition, support 13 may include a first support and a second support which is provided on a downstream side of sheet heating element 14. In this case, the second support is preferably made of a material having higher heat conductivity than the first support, as a main component thereof.

Moreover, support 13 and sheet heating element 14 are fixed members that are configured to slide relative to the rotation of fixing belt 12.

In this embodiment, support 13 is preferably made of a metal having high heat conductivity as the main component. Support 13 is heated by the heat from sheet heating element 14 so that it is possible to heat fixing belt 12 by use of both of sheet heating element 14 and support 13. On the other hand, when support 13 is made of a heat-insulating material, fixing belt 12 is heated solely by sheet heating element 14 because support 13 is not heated by the heat from sheet heating element 14. As described in this embodiment, having a larger area for transmitting the heat for heating fixing belt 12, the configuration to heat fixing belt 12 by using both of sheet heating element 14 and support 13 has higher heat transfer efficiency. In addition, since the area for transmitting the heat is large, application of electric power of the same level results in a smaller power density thus allowing fixing belt 12 to be heated at a lower temperature than otherwise.

Sheet heating element 14 is typically a ceramic heater, a stainless steel heater, or the like, and a surface thereof to be in contact with the inner surface of fixing belt 12 is formed either in a flat or arc shape.

As shown in FIG. 6A, when the surface to be in contact with the inner surface of fixing belt 12 has the flat shape, sheet heating element 14 includes: base plate 41 having a lower surface formed into a flat shape; electrically insulating layer 42 formed on base plate 41; resistance heating element 43 and electrodes 44 formed on electrically insulating layer 42, and protective layer 45 formed on resistance heating element 43 and electrodes 44.

Here, base plate 41 is made of a metal such as SUS430 as a main component. Electrically insulating layer 42 may be a thinly-formed glass film. Further, resistance heating element 43 may be formed by screen-printing, onto electrically insulating layer 42, paste made of powder of either a nickel-chromium alloy or a silver-palladium alloy. Moreover, electrode 44 may be made of either a chemically stable metal having lower electrical resistance such as silver or a high-melting-point metal such as tungsten, and may be formed on an end portion of resistance heating element 43. In addition, protective layer 45 may be made of glass or a typical fluorine-containing resin such as PTFE, PFA or FEP. Protective layer 45 protects electrically insulating layer 42, resistance heating element 43, and electrodes 44.

Here, in the case of sheet heating element 14 shown in FIG. 6A, the surface to be in contact with the inner surface of fixing belt 12 may be either the lower surface of base plate 41 or the surface where protective layer 45 is provided.

When the surface to be in contact with the inner surface of fixing belt 12 has the arc shape, sheet heating element 14 includes base plate 41 having a lower surface formed into a convex curved shape as shown in FIG. 6B. Note that, electrically insulating layer 42, resistance heating element 43, electrodes 44, and protective layer 45 are similar to those of sheet heating element 14 illustrated in FIG. 6A. In the case of sheet heating element 14 illustrated in FIG. 6B, the surface to be in contact with the inner surface of fixing belt 12 is the lower surface of base plate 41.

Moreover, when the surface to be in contact with the inner surface of fixing belt 12 has the arc shape, sheet heating element 14 may include base plate 41 having a lower surface formed into a concave curved shape as shown in FIG. 6C. Note that, electrically insulating layer 42, resistance heating element 43, electrodes 44, and protective layer 45 are similar to those of sheet heating element 14 illustrated in FIG. 6A. In the case of sheet heating element 14 illustrated in FIG. 6C, the surface to be in contact with the inner surface of fixing belt 12 is the lower surface of base plate 41.

As shown in FIG. 7A or FIG. 7B, a chamfered portion or a curved portion may be formed at an end portion of sheet heating element 14, the end portion arranged on a downstream side in the rotating direction of fixing belt 12 and on the surface to be in contact with the inner surface of fixing belt 12. In this way, it is possible to suppress abrasion of fixing belt 12.

As shown in FIG. 8, sheet heating element 14 includes heat generating region 14*a* and electrode portions 14*b* arranged on both ends thereof. Moreover, contact length L1 ([mm]) between support 13 and sheet heating element 14 and length L2 ([mm]) of heat generating region 14*a* of sheet heating element 14 satisfy a relation of $L1 \leqq L2$. Meanwhile, length L2 ([mm]) of heat generating region 14*a* of sheet heating element 14 and length L3 ([mm]) of entire sheet heating element 14 inclusive of electrode portions 14*b* on the both ends satisfy a relation of $L2 < L3$.

As shown in FIG. 6A, FIG. 6B, and FIG. 6C, electrode portions 14*b* are the regions in which electrodes 44 for applying electric power to heat generating region 14*a* are provided. Electrode portions 14*b* are arranged away from heat generating region 14*a* so as not to raise the temperature of an unillustrated connector connected to electrodes 44. That is, the relation $L2 < L3$ is established in order to avoid electrode portions 14*b* from being heated to a high temperature. For this reason, the heat generated in heat generation region 14*a* escapes to electrode portions 14*b* so that the temperature in the heat generating region 14*a* becomes higher at a central portion while lower on the sides close to electrode portions 14*b*. Here, when the relation $L1 \leqq L2$ is established, it is possible to suppress the uneven temperature distribution in heat generating region 14*a* by adjusting length L1 in a way that the heat on the sides close to electrode portions 14*b* in heat generating region 14*a* is not transmitted to support 13.

Fixing belt 12 is thin and highly flexible so that its contact with support 13 and sheet heating element 14 may become unstable when fixing belt 12 is rotated. As a consequence, it is conceivable that the heat is not sufficiently transmitted from support 13 and sheet heating element 14 to fixing belt 12, thereby inadequately heating fixing belt 12. Therefore, as shown in FIG. 9, it is preferable that auxiliary roller 17 be arranged as a pressure-contacting member in such a position to face sheet heating element 14 with fixing belt 12 interposed therebetween. Auxiliary roller 17 presses fixing belt 12 against sheet heating element 14, thereby bringing fixing belt 12 into stable contact with sheet heating element 14 heated to a high temperature.

Auxiliary roller 17 includes a cored bar having a cylindrical or columnar shape, and an elastic layer formed around the cored bar, similarly to fixing roller 11 and pressing roller 16. Here, auxiliary roller 17 may further include a releasing layer which is formed around the elastic layer.

The cored bar is preferably a solid or hollow shaft made of a metal such as aluminum, iron or stainless steel in order to maintain specified rigidity. It is usually preferable that the elastic layer is made of a highly heat-resistant rubber material such as silicone rubber, sponge silicone rubber or fluorine-containing rubber as a main component. Further, the releasing layer is preferably made of a typical fluorine-containing resin such as PTFE, PFA or FEP and the thickness thereof is set preferably in a range from about 10 to 50 [μm]. Instead of the elastic layer, a sponge material or felt for applying a releasing agent such as silicon oil or fluorine oil may be formed around the cored bar.

A binder resin used in toner 18 may be polystyrene, styrene/propylene copolymer, styrene/vinylnaphthalene copolymer, styrene/methyl acrylate copolymer, polyester-based copolymer, polyurethane-based copolymer, epoxy-based copolymers, aliphatic or alicyclic hydrocarbon resins, aromatic petroleum resins, or the like. It is possible to use any one of or a combination of these resins.

Note that toner 18 may contain wax in order to prevent offset at the time of fixing. In that case, the wax may be polyethylene wax, propylene wax, carnauba wax, or various ester-based wax agents.

Next, an operation of fixing device 10 having the above-described configuration is described. As shown in FIG. 1, fixing belt 12 is rotated by pressing roller 16 in the direction of the arrow while sliding on support 13 and sheet heating element 14. Then, when electric power is supplied to sheet heating element 14, the portion of fixing bent 12 that is in contact with support 13 and sheet heating element 14 is heated.

While the unillustrated temperature sensor detects the surface temperature of fixing belt 12, an unillustrated controller controls power supply to sheet heating element 14 based on the surface temperature detected by the temperature sensor and then maintains the surface of fixing belt 12 to an appropriate temperature.

Pressing roller 16 is pressed against fixing roller 11 with fixing belt 12 interposed therebetween, thereby forming a nip portion. Then, recording medium 19 to which toner 18 is transferred is conveyed by way of the nip portion formed by fixing belt 12 and the pressing roller 16. In this way, toner 18 on recording medium 19 is heated and pressed by fixing belt 12 and pressing roller 16 and thereby fixed onto recording medium 19.

Examples shown in FIG. 5A, FIG. 5B, and FIG. 5C are respectively: an example in which sheet heating element 14 is arranged on an end portion of support 13 on the downstream side in the direction of travel of fixing belt 12; an example in which sheet heating element 14 is arranged in a center portion of support 13 in the direction of travel of fixing belt 12; and an example in which sheet heating element 14 is arranged on an end portion of support 13 on an upstream side in the direction of travel of fixing belt 12, respectively.

Setup time is measured under the following evaluation conditions by using an A4-size-longitudinal-feeding fixing device provided with heaters 15 of these three types. The results are: 25 seconds in the example shown in FIG. 5A; 31 seconds in the example shown in FIG. 5B; and 35 seconds in the example shown in FIG. 5C.

Evaluation Conditions

Fixing belt: inner diameter 45 [mm], polyimide 90 [μm], silicone rubber 200 [μm], PFA 30 [μm]

Fixing roller: ϕ30, elastic layer—silicone sponge 8 [mm], ASKER C Hardness 35 degrees Pressing roller: ϕ30, releasing layer 30 [μm], PFA, elastic layer—silicone sponge 8 [mm], ASKER C Hardness 35 degrees Pressure: 12 [kg·f]

Sheet heating element: stainless steel heater—width 12 [mm], 800 [W], pressure load 1.0 [kg·f]

Support: aluminum—thickness 1.5 [mm], contact length 30 [mm] (inclusive of sheet heating element), volumes and heat capacities equal among all three types Target temperature: from 20 [° C.] to 160 [° C.]

Nip width: 9 [mm]

Circumferential speed: 200 [mm/s]

As described above, according to this embodiment, the setup time becomes particularly shorter when applying the configuration of heater 15 as shown in FIG. 5A, that is, when sheet heating element 14 is arranged at the end portion of the support 13 on the downstream side in the direction of travel of fixing belt 12.

The three types of heaters 15 having the above-described configurations have the same heat capacity and the same contact area of support 13. Nevertheless, these heaters exhibit different setup time for the following reason.

Sheet heating element 14 has a high temperature when power is supplied thereto, whereas support 13 has a lower temperature at a portion thereof farther from sheet heating element 14. For this reason, in the example shown in FIG. 5C, the temperature of fixing belt 12 is, first, rapidly raised by being in contact with sheet heating element 14. However, after fixing belt 12 passes by sheet heating element 14, the surface temperature of support 13 drops gradually according to the distance from sheet heating element 14. Thus, a temperature difference between support 13 and fixing belt 12 becomes smaller and the heat flux received by fixing belt 12 is gradually reduced. On the other hand, in the example shown in FIG. 5A, fixing belt 12 is brought into contact with the low-temperature portion of support 13 first. Then, the temperature of support 13 gradually rises as support 13 approaches sheet heating element 14. Therefore, the temperature difference between support 13 and fixing belt 12 is not reduced so that the heat flux received by fixing belt 12 does not become smaller. The example shown in FIG. 5B requires setup time whose length is almost an average of those of the examples shown in FIG. 5A and FIG. 5C.

As described above, when sheet heating element 14 is arranged at the end portion on support 13 on the downstream side in the rotating direction of fixing belt 12, that is, in the direction of travel thereof, the heat transfer efficiency to fixing belt 12 is the highest. With high heat transfer efficiency, application of the same power to the heating target can lead to transfer of a larger heat amount than otherwise. Therefore, when compared in the same time period, the heating target can be heated to a higher temperature, and also heated to a target temperature in a shorter time period. Among the examples shown in FIG. 5A, FIG. 5B, and FIG. 5C, the configuration of heater 15 shown in the example of FIG. 5A achieves the highest heat transfer efficiency. Accordingly, the setup time becomes the shortest for the same power amount.

Next, a second embodiment is described. Note that the constituents having the same configurations as those in the first embodiment are designated by the same reference numerals, and the explanations thereof are omitted. Similarly, the explanations of the same operations and effects as those in the first embodiment are omitted as well.

Figure 10:
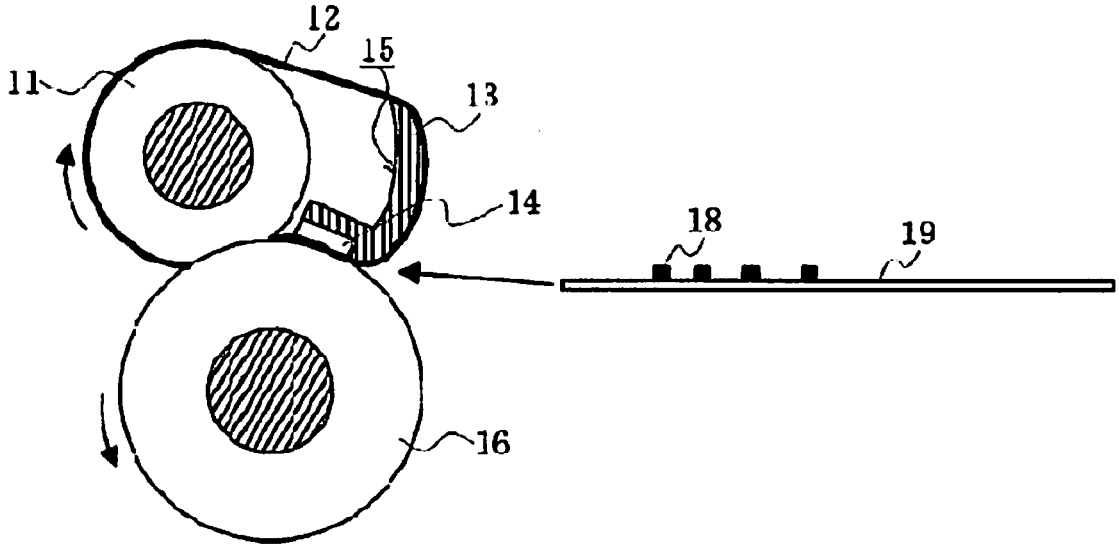
FIG. 10 is a cross-sectional view of a fixing device in a second embodiment.
Figure 11:
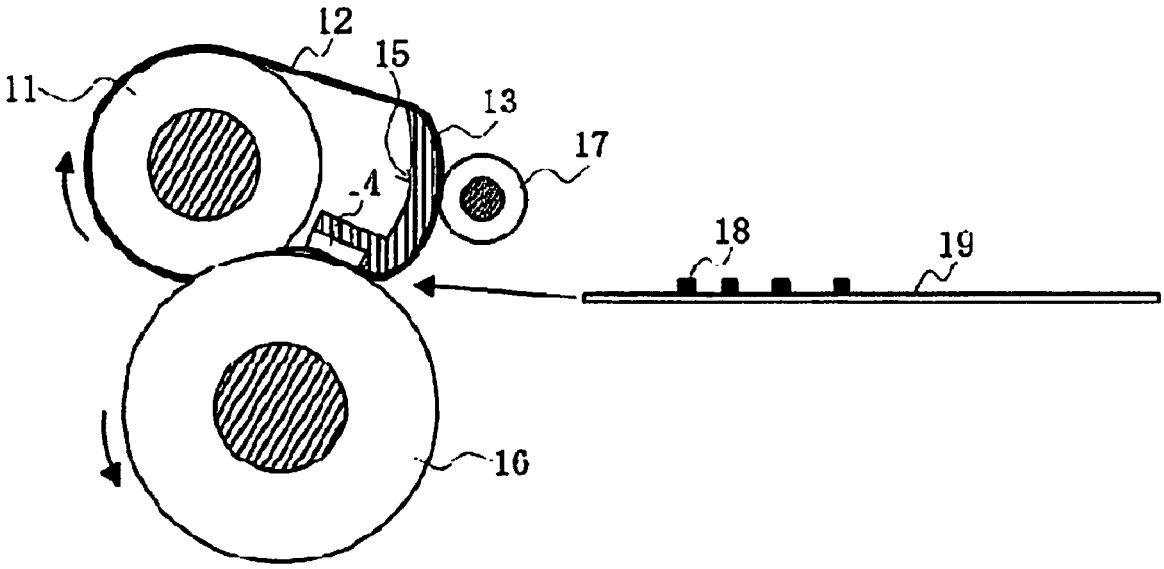
FIG. 11 is a cross-sectional view showing a modified example of the fixing device in the second embodiment.
Figure 12:
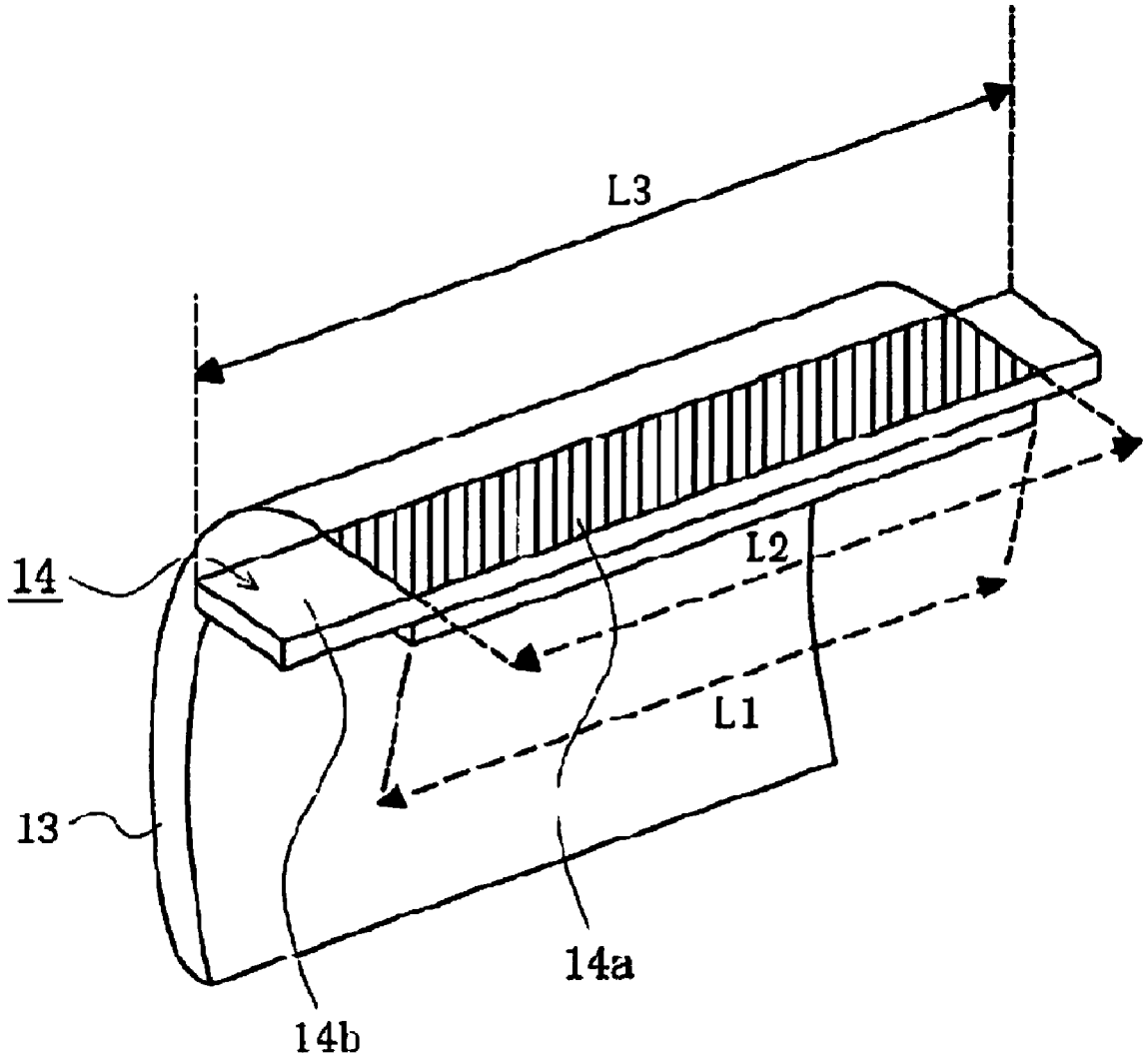
FIG. 12 is a perspective view of a heater in the second embodiment.

FIG. 10 is a cross-sectional view of a fixing device in the second embodiment. FIG. 11 is a cross-sectional view showing a modified example of the fixing device in the second embodiment. FIG. 12 is a perspective view of a heater in the second embodiment.

As shown in FIG. 10, fixing device 10 in this embodiment includes fixing roller 11, pressing roller 16, fixing belt 12, and heater 15. Heater 15 includes sheet heating element 14 and a support 13 which is integrated with sheet heating element 14 so as to support sheet heating element 14. Fixing belt 12 is suspended in a tensioned state between fixing roller 11 and support 13. In this case, the pressure of support 13 against fixing belt 12 is preferably set approximately equal to a maximum of 2 [kg·f] so as minimize sliding friction between support 13 and fixing belt 12.

Both fixing roller 11 and sheet heating element 14, in an integrated state with support 13, are pressed against pressure roller 16 with fixing belt 12 interposed in between, thereby forming a nip portion there-between. Here, part of support 13 may form a nip portion, together with sheet heating element 14. In examples shown in FIG. 10 and FIG. 11, part of support 13 and sheet heating element 14 collectively form the nip portion.

Further, an unillustrated temperature sensor is arranged either on an outer surface or on an inner surface of fixing belt 12. The temperature sensor may be in contact with fixing belt 12 or may be formed as a non-contact component having a small gap between the temperature sensor and fixing belt 12.

Then, recording medium 19 to which toner 18 is transferred is conveyed by way of the nip portion formed by fixing belt 12 and pressure roller 16. In this way, toner 18 on recording medium 19 is heated and pressed by fixing belt 12 and pressing roller 16 and thereby fixed onto recording medium 19.

Similar to the first embodiment as shown in FIG. 3A, fixing roller 11 and pressure roller 16 in this embodiment each include cored bar 31 having either a cylindrical or columnar shape, and elastic layer 32 formed around cored bar 31. Here, as shown in FIG. 3B, pressing roller 16 may further include releasing layer 33 which is formed around elastic layer 32.

Cored bar 31 is formed as a solid or hollow shaft made of a metal such as aluminum, iron or stainless steel in order to maintain specified rigidity. Elastic layer 32 is usually made of a highly heat-resistant rubber material such as silicone rubber, sponge silicone rubber or fluorine-containing rubber.

Pressure roller 16 is driven from an unillustrated motor or the like and is rotated in a direction indicated with arrows in FIG. 10 and FIG. 11. Fixing belt 12 is driven by friction with pressure roller 16 and is thereby rotated in a direction indicated with other arrows in FIG. 10 and FIG. 11. Further, fixing roller 11 is driven by friction with fixing belt 12 and is thereby rotated in a direction indicated with yet other arrows in FIG. 10 and FIG. 11.

Similar to the first embodiment, as shown in FIG. 4A, fixing belt 12 in this embodiment is a laminated body which includes thin base body 34*a*, elastic layer 34*b* formed on base body 34*a*, and releasing layer 34*c* formed on elastic layer 34*b*. Here, as shown in FIG. 4B, fixing belt 12 may be a laminated body which includes thin base body 34*a* and releasing layer 34*c* formed directly on base body 34*a*. Then, fixing belt 12 is suspended in a tensioned state between fixing roller 11 and support 13 with releasing layer 34*c* located on its outer side.

Base body 34*a* is preferably made of nickel, polyimide, stainless steel or the like and is preferably formed in a thickness range from about 30 to 150 [μm] to simultaneously achieve strength and flexibility.

Elastic layer 34*b* is preferably made of either silicone rubber or fluorine-containing rubber as a main component. In the case of silicone rubber, it is preferable to set the thickness in a range from about 50 to 300 [μm] in order to simultaneously achieve low hardness and high heat conductivity. In the case of fluorine-containing rubber, it is preferable to set the thickness in a range from about 10 to 50 [μm] in order to simultaneously achieve low friction and high heat conductivity.

Further, similar to releasing layer 33 of pressure roller 16, release layer 34*c* is preferably made of a resin having high heat resistance and low surface free energy after shaping, for example, a typical fluorine-based resin such as PTFE, PFA or FEP. Here, it is preferable to set the thickness in a range from about 10 to 50 [μm].

Support 13 of heater 15 is preferably made of any one of: a metal having high heat conductivity and high workability such as aluminum or copper; an alloy that contains any of such metals as a main component; and any of iron, an iron alloy, stainless steel and the like having high heat resistance and high rigidity. Note that support 13 is integrated with sheet heating element 14 without using particular adhesion, by pressing support 13 against pressing roller 16 with fixing belt 12 interposed there-between. As shown in FIG. 10 and FIG. 11, sheet heating element 14 is arranged at an end portion of support 13 on a downstream side in a rotating direction of fixing belt 12, that is, in the direction of travel thereof.

Similar to the first embodiment, configuring sheet heating element 14 at the end portion of support 13 is equivalent to the configuration as shown in the examples shown in FIG. 5A or FIG. 5C, in which no more than two side surfaces of sheet heating element 14 are surrounded by support 13 so that one side surface of sheet heating element 14 constitutes an end surface of heater 15. Incidentally, in the example shown in FIG. 5B, sheet heating element 14 is not arranged at the end portion of support 13 so that three side surfaces of sheet heating element 14 are surrounded by support 13.

Moreover, sheet heating element 14 is typically a ceramic heater, a stainless steel heater, or the like, and a surface thereof to be in contact with the inner surface of fixing belt 12 is formed either in a flat or arc shape.

Similar to the first embodiment, as shown in FIG. 6A, when the surface to be in contact with the inner surface of fixing belt 12 has the flat shape, sheet heating element 14 includes: base plate 41 having a lower surface formed into a flat shape; electrically insulating layer 42 formed on base plate 41; resistance heating element 43 and electrodes 44 formed on electrically insulating layer 42; and protective layer 45 formed on resistance heating element 43 and electrodes 44.

Base plate 41 is preferably made of a metal such as SUS430 as a main component. Electrically insulating layer 42 may be a thin glass film. Further, resistance heating element 43 may be formed by screen-printing, onto electrically insulating layer 42, paste made of powder of either a nickel-chromium alloy or a silver-palladium alloy. Moreover, electrode 44 may be made of either a chemically stable metal having lower electrical resistance such as silver or a high-melting-point metal such as tungsten, and may be formed on an end portion of resistance heating element 43. In addition, protective layer 45 may be made of glass or a typical fluorine-containing resin such as PTFE, PFA or FEP. Protective layer 45 protects electrically insulating layer 42, resistance heating element 43, and electrodes 44.

Here, in the case of sheet heating element 14 shown in FIG. 6A, the surface to be in contact with the inner surface of fixing belt 12 may be either the lower surface of base plate 41 or the surface where protective layer 45 is provided.

When the surface to be in contact with the inner surface of fixing belt 12 has the arc shape, sheet heating element 14 includes base plate 41 having a lower surface formed into a convex curved shape as shown in FIG. 6B. Note that, electrically insulating layer 42, resistance heating element 43, electrodes 44, and protective layer 45 are similar to those of sheet heating element 14 illustrated in FIG. 6A. In the case of sheet heating element 14 illustrated in FIG. 6B, the surface to be in contact with the inner surface of fixing belt 12 is the lower surface of base plate 41.

Moreover, when the surface to be in contact with the inner surface of fixing belt 12 has the arc shape, sheet heating element 14 may include base plate 41 having a lower surface formed into a concave curved shape as shown in FIG. 6C. Note that, electrically insulating layer 42, resistance heating element 43, electrodes 44, and protective layer 45 are similar to those of sheet heating element 14 illustrated in FIG. 6A. In the case of sheet heating element 14 illustrated in FIG. 6C, the surface to be in contact with the inner surface of fixing belt 12 is the lower surface of base plate 41.

Similar to the first embodiment, as shown in FIG. 7A or FIG. 7B, a chamfered portion or a curved portion may be formed at an end portion of sheet heating element 14, the end portion arranged on a downstream side in the rotating direction of fixing belt 12 and on the surface to be in contact with the inner surface of fixing belt 12. In this way, it is possible to suppress abrasion of fixing belt 12.

Here, as shown in FIG. 12, sheet heating element 14 includes heat generating region 14*a* and electrode portions 14*b* arranged on both ends thereof. Moreover, contact length L1 ([mm]) between support 13 and sheet heating element 14 and length L2 ([mm]) of heat generating region 14*a* of sheet heating element 14 satisfy a relation of $L1 \leqq L2$. Meanwhile, length L2 ([mm]) of heat generating region 14*a* of sheet heating element 14 and length L3 ([mm]) of entire sheet heating element 14 inclusive of electrode portions 14*b* on the both ends satisfy a relation of $L2 < L3$.

In the configuration as shown in FIG. 10, the direction of travel of fixing belt 12 is abruptly changed at an entrance of the nip portion. This causes the contact between fixing belt 12 and support 13 to be unstable during rotation, and thus uneven distribution of the surface temperature may occur in fixing belt 12. Therefore, as shown in FIG. 11, it is preferable to press auxiliary roller 17 against support 13 with fixing belt 12 interposed there between, so as to bring support 13 into stable contact with fixing belt 12.

Similar to fixing roller 11 and pressing roller 16, auxiliary roller 17 includes a cored bar and an elastic layer on a surface thereof. Here, a releasing layer may be further formed around the elastic layer.

Cored bar 31 is formed as a solid or hollow shaft made of a metal such as aluminum, iron or stainless steel in order to maintain specified rigidity. The elastic layer is made of a highly heat-resistant rubber material such as silicone rubber, sponge silicone rubber or fluorine-containing rubber. Further, the releasing layer is made of a typical fluorine-containing resin such as PTFE, PFA or FEP. Instead of the elastic layer, a sponge material or felt for applying a releasing agent such as silicon oil or fluorine oil may be formed around the cored bar.

A binder resin used in toner 18 may be polystyrene, styrene/propylene copolymer, styrene/vinylnaphthalene copolymer, styrene/methyl acrylate copolymer, polyester-based copolymer, polyurethane-based copolymer, epoxy-based copolymers, aliphatic or alicyclic hydrocarbon resins, aromatic petroleum resins, or the like. It is possible to use any one of or a combination of these resins.

Note that toner 18 may contain wax in order to prevent offset at the time of fixing. In that case, the wax may be polyethylene wax, propylene wax, carnauba wax, or various ester-based wax agents.

Since the configuration of image forming apparatus 100 is similar to the first embodiment, description thereof is omitted.

Next, an operation of fixing device 10 of this embodiment is described. As shown in FIG. 10, fixing belt 12 is rotated by pressure roller 16 in the direction of the arrow while sliding on support 13 and sheet heating element 14. Then, when electric power is supplied to sheet heating element 14, the portion of fixing belt 12 that is in contact with support 13 and sheet heating element 14 is heated.

While the unillustrated temperature sensor detects the surface temperature of fixing belt 12, an unillustrated controller controls power supply to sheet heating element 14 based on the surface temperature detected by the temperature sensor and then maintains the surface of fixing belt 12 to an appropriate temperature.

In addition, sheet heating element 14 or sheet heating element 14 and the part of support 13 are pressed together with fixing roller 11 against pressure roller 16 with fixing belt 12 interposed there-between, thereby forming a nip portion with fixing roller 11. Then, recording medium 19 to which toner 18 is transferred is conveyed by way of the nip portion formed by fixing belt 12 and the pressure roller 16. In this way, toner 18 on recording medium 19 is heated and pressed by fixing belt 12 and pressing roller 16 and thereby fixed onto recording medium 19.

Setup time is measured under the following evaluation conditions by using an A4-size-longitudinal-feeding fixing device provided with heaters 15 having the above configuration. The result is 18 seconds.

Evaluation Conditions

Fixing belt: inner diameter 45 [mm], polyimide 90 [μm], silicone rubber 200 [μm], PFA 30 [μm]

Fixing roller: ϕ24, elastic layer—silicone sponge 5 [mm], ASKER C Hardness 35 degrees Pressing roller: ϕ30, releasing layer 30 [μm], PFA, elastic layer—silicone sponge 8 [mm], ASKER C Hardness 35 degrees Pressure: 12 [kg·f]

Sheet heating element: stainless steel heater—width 8 [mm], 800 [W], pressure load 1.0 [kg·f]

Support: aluminum—thickness 2.0 [mm], contact length 25 [mm] (inclusive of sheet heating element)

Target temperature: from 20 [° C.] to 160 [° C.]

Nip width: 12 [mm]

Circumferential speed: 200 [mm/s]

As described above, in this embodiment, pressing roller 16 is similar while the heat capacity of support 13 is slightly increased in comparison with the first embodiment. It is thereby possible to increase the nip width and to reduce the diameter of fixing roller 11. Accordingly, the setup time can be significantly reduced.

In the first embodiment, the nip width of 9 [mm] is formed by fixing roller 11. On the other hand, in this embodiment, the nip width of slightly under 4 [mm] obtained by subtracting the width of 8 [mm] of sheet heating element 14 and a gap between fixing roller 11 and heater 15 from the entire nip width of 12 [mm], is formed by use of fixing roller 11. Therefore, according to the configuration of this embodiment, it is possible to use fixing roller 11 having a smaller diameter.

In terms of the heat capacity of support 13, there is not a large difference between the first embodiment and this embodiment because the plate thickness is cancelled by the contact length. However, in terms of fixing roller 11, this embodiment succeeds in drastically reducing the heat capacity by reducing the diameter from ϕ30 to ϕ24. Therefore, the heat capacity of entire fixing device 10 becomes smaller in this embodiment, thus shortening the setup time.

As described above, according to the fixing device and the image forming apparatus of this embodiment, the sheet heating element is arranged on the end portion of the heater on the downstream side in the direction of travel of the fixing belt, the heater configured to heat the fixing belt. In this way, it is possible to improve the efficiency of heat transfer to the fixing belt, to heat the fixing belt to a predetermined temperature in a shorter time period, and to shorten the setup time required to begin fixing.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A fixing device comprising:

an endless fixing belt;

a first rotating body arranged at an inner side of the fixing belt; and a heater arranged to face an inner surface of the fixing belt and configured to heat the fixing belt and to suspend the fixing belt in a tensioned state together with the first rotating body, the heater comprising:

a heat generating unit arranged at an end portion of the heater on a downstream side in a direction of travel of the fixing belt and configured to heat the fixing belt, wherein, a length of a heat generating region of the heat generating unit is less than an entire length of the heat generating unit; and a support including metal and configured to support the heat generating unit, wherein a contact length between the support and the heat generating unit is defined as l1, a length of a heat generating region of the heat generating unit is defined as l2, and l1 and l2 satisfy the relation l1≦l2.

2. The fixing device of claim 1, wherein the heat generating unit is a sheet heating element.

3. The fixing device of claim 1, wherein the heat generating unit comprises a chamfered portion at an end portion thereof on the downstream side.

4. The fixing device of claim 1, wherein the heat generating unit comprises a curved portion at an end portion thereof on the downstream side.

5. The fixing device of claim 1, wherein a side surface of the heat generating unit is an end surface of the heater on the downstream side.

6. The fixing device of claim 1, further comprising a second rotating body pressed against at least the first rotating body with the fixing belt interposed there between.

7. The fixing device of claim 6, wherein the second rotating body is pressed against the heater with the fixing belt interposed therebetween.

8. The fixing device of claim 6, wherein a portion where the first rotating body and the second rotating body are pressed against each other includes a fixing region.

9. The fixing device of claim 1, further comprising a pressure-contact member pressed against the heater with the fixing belt interposed there between.

10. An image forming apparatus comprising a fixing device defined in claim 1.

11. The fixing device of claim 1, wherein the fixing belt comprises a laminate body that includes a base body on the support side, an elastic layer formed on the base body, and a releasing layer formed on the elastic layer.

12. The fixing device of claim 1, wherein the fixing belt comprises a laminate body that includes a base body on the support side and a releasing layer formed on the base body.

13. The fixing device of claim 1, wherein the heat generating unit is disposed at an end portion of the support on a downstream side in a direction of travel of the fixing belt.

14. The fixing device of claim 9, wherein the pressure-contact member faces the support at a different position from that of the heat generating unit.

15. The fixing device of claim 1, wherein the heat generating unit press-contacts against the second rotating body on the upstream side of a nip portion between the first rotating body and the second rotating body.

* * * * *